United States Patent [19]

Federer et al.

[11] Patent Number: 4,975,576

[45] Date of Patent: Dec. 4, 1990

[54] METHOD AND APPARATUS FOR MEASURING CONCENTRATIONS OF GAS MIXTURES

[75] Inventors: Werner Federer, Rum; Johannes Villinger, Innsbruck, both of Austria

[73] Assignee: V & F Analyse- und Messtechnik GmbH, Austria

[21] Appl. No.: 313,977

[22] PCT Filed: May 4, 1988

[86] PCT No.: PCT/AT88/00026

§ 371 Date: Jan. 13, 1989

§ 102(e) Date: Jan. 13, 1989

[87] PCT Pub. No.: WO88/09052

PCT Pub. Date: Nov. 17, 1988

[30] Foreign Application Priority Data

May 14, 1987 [AT] Austria ..... 1226/87

[51] Int. Cl.[5] ..... H01J 49/14; H01J 49/42

[52] U.S. Cl. ..... 250/282; 250/288; 250/281; 436/173

[58] Field of Search ..... 250/282, 288, 281; 436/173

[56] References Cited

U.S. PATENT DOCUMENTS

| | | | |
|---|---|---|---|
| 3,555,272 | 1/1971 | Munson et al. | 250/288 |
| 4,005,291 | 1/1977 | Arsenault | 250/282 |
| 4,234,791 | 11/1980 | Enke et al. | 250/281 |
| 4,378,499 | 3/1983 | Spangler et al. | 250/287 |

FOREIGN PATENT DOCUMENTS 2028805 10/1973 Fed. Rep. of Germany .

OTHER PUBLICATIONS

Kalinoski et al, Analytical Chemistry, vol. 58, No. 12, Oct. 1986, pp. 2421–2425.

Szabo, International Journal of Mass Spectrometry and Ion Processes, vol. 73, No. 3, Nov. 28, 1986, pp. 197–235.

*Primary Examiner*—Jack I. Berman

*Attorney, Agent, or Firm*—Hill, Van Santen, Steadman & Simpson

[57] ABSTRACT

For identifying the concentration of individual types of molecules in a gas mixture, the gas mixture to be investigated is subjected to a selective pre-treatment and the product of this pre-treatment is then mass-spectrometrically investigated. For separate concentration identification of molecules having identical molecular mass, the gas mixture is ionized with primary ions that have an internal energy slightly above that required for generating product ions representing the respective type of molecule of interest and that have a pulse energy of such an amount that the kinetic effect on the ionization is negligible in comparison to the influence of the internal energy. The mass-spectrometric investigation then supplies the sought concentration of the individual type of molecule in a simple and precise fashion.

14 Claims, 1 Drawing Sheet

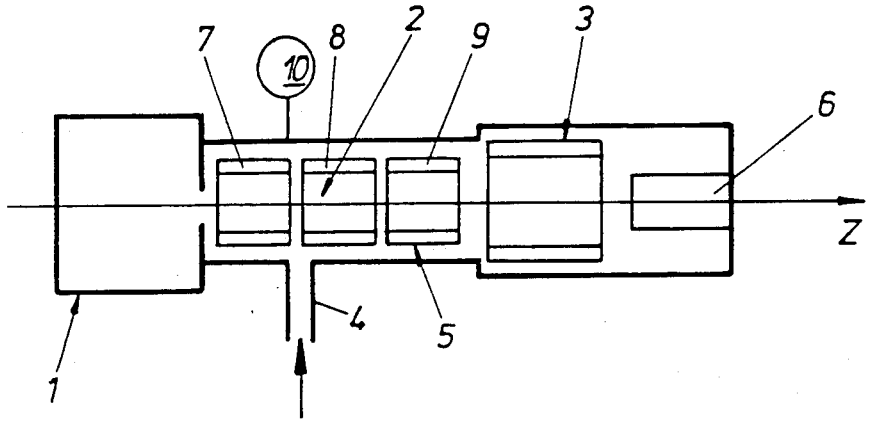
7
10
8
2
9
3
6
Z
4
5
1

METHOD AND APPARATUS FOR MEASURING CONCENTRATIONS OF GAS MIXTURES

The invention is directed to a method for identifying the concentrations of individual types of molecules in gas mixtures, whereby the gas mixture to be examined is subjected to a selective pre-treatment and the product of this pre-treatment is then examined mass spectrometrically. The invention is also directed to an apparatus for the implementation of such a method.

Deriving as a direct problem in the mass-spectrometric examination of gas mixtures containing different types of molecule for the concentrations of individual types of molecule, is that different molecules having identical molecular mass cannot be separately recognized by the mass spectrometer due to the physical conditions on which the function thereof is based. For example, this applies to the combination of nitrogen monoxide (NO) and formaldehyde ($CH_2O$) each having 30 amu (atomic mass unit), to the combination of oxygen ($O_2$) and methylalcohol ($CH_3OH$) each having 32 amu, and to the combination of CO with $N_2$ and $C_2H_6$ each of which has 28 amu.

Since measurement with a mass spectrometer is relatively simple to manipulate, and is precise and fast, efforts were undertaken to remedy this disadvantage. Methods and, respectively, apparatus of the species initially cited have been disclosed wherein the gas mixture to be examined is subjected to a selective pre-treatment in order to enable a pre-separation of the types of molecules of interest that have the same molecular mass.

Among the apparatus that have become known are those sold under the designation GCMS Systems. In the GCMS Systems apparatus a gas chromatograph is employed thereto, this enabling a chronologically graduated feed of the individual types of molecules to the mass spectrometer that carries out the actual measurement. The chronological graduated feed occurs as a result of the different transit times of the individual types of molecules and thus enables a separate identification—at least within limits—of the individual types of molecules or, respectively, of their concentration. For example, the molecules $N_2O$ and $CO_2$ that have the same molecular mass can thus be separately acquired, these having noticeably different transit times in the gas chromatograph.

In this context, however, there are already problems. For example, in the detection of different alcohols that have similar transit times in the gas chromatograph and that are fragmented in the mass spectrometer, the separate identification of individual types of molecules is impossible in practice. The extremely low response speed of these GCMS Systems is to be cited as a further disadvantage, this response speed, of course, being greatly restricted by the transit times of the gas mixtures being examined or, respectively, of the types of molecules to be detected in the gas chromatograph.

SUMMARY OF THE INVENTION

An object of the present invention is an improved method or, respectively, apparatus of the species initially cited such that the disadvantages of the known arrangements are avoided and such that, in particular, the concentration of individual types of molecules having the same molecular mass can be identified in a simple way in gas mixtures under examination without great delays caused by the measurement or by the preparation of the gas mixture for the measurement.

For separate identification of the concentration of molecules having the same molecular mass, this is inventively achieved in that the gas mixture to be examined is ionized with primary ions under single pulse conditions in hard vacuum, whereby the primary ions employed have an internal energy slightly above, preferably $\leqq 2$ eV above, that required for generating product ions representing the respective type of molecule of interest, and have a translational pulse energy of such an amount in the respective center-of-mass system that the kinetic effect on the ionization is negligible in comparison to the influence of the internal energy, preferably a pulse energy below 10 eV, and in that the mass-spectrometric examination is undertaken at the product ions.

In accordance with the invention, an apparatus for identifying the concentrations of individual types of molecule in gas mixtures includes an arrangement for selective pre-treatment of the gas mixture to be examined and a mass spectrometer arrangement for the examination of the product of this pre-treatment; wherein the pre-treatment arrangement comprises an ion source for primary ions, a reaction space connecting to the ion source and having a feed for the gas mixture to be examined, and a pump for creating hard vacuum; in that the mass spectrometer arrangement is arranged at that side of the reaction space that essentially faces away from the ion source; in that the ion source emits primary ions having an internal energy slightly above preferably $\leqq 2$ eV above that required for generating product ions representing the respective type of molecule of interest and with a translational pulse energy below 10 eV; and in that the reaction space is surrounded by an octopole arrangement at which a radio frequency guide potential is adjacent.

In accordance with the invention, thus, the selective pretreatment of the gas mixture to be examined is directly undertaken by the ionization with the primary ions having a defined internal energy (ionization potential) given limited translational pulse energy, the stated disadvantages of the GCMS Systems initially set forth being therewith avoided and the concentrations of molecules having the same molecular mass also being separately identifiable in a simple and fast way.

As they are presently usually operated, mass spectrometer arrangements have significant deficiencies as a consequence of the ionization process with electrons that is employed, these deficiencies greatly restricting their applicability to various problems or, respectively, making this impossible. Particularly included among these deficiencies are the fragmentation from various substances, the identical fragmentation from various substances, as well as the interferences due to identical mass of the ions from various substances. In the ionization event with electrons, these are usually brought to a kinetic energy of at least 70 eV for this process. The activation cross sections or, respectively, the ionization efficiency lies on usable orders of magnitude given these energies; however, the fragmentation of molecules into fragments must be accepted as a critical disadvantage. Thus, for example, $CO_2+e^-$ becomes $CO_2^+$, $O_2^+$, $CO^+$, $O^+$ and $C^+$. $CO+e^-$ becomes $CO^+$, $C^+$ and $O^+$. $O_2+e^-$ becomes $O_2^+$, $O^+$. It can be easily seen that the identification of the concentration of individual molecule types in gas mixtures thus becomes impossible in most cases.

Let the following serve as an example of the fragmentation of molecules having similar structure in the atomic structure in similar spectra: $CH_3OH+e^-$ becomes $C^+$; $CH_3^+$, $CH_2^+$, $CH^+$; $OH^+$, $O^+$; $CH_3OH^+$. $C_2H_5OH+e^-$ becomes $C^+$; $CH_3^+$, $CH_2^+$, $CH^+$; $OH^+$, $O^+$; $CH_3OH^+$; $C_2H_5OH^+$.

The present invention then proceeds on the basis of the perception that the neutral molecules can be converted into ions without thereby being ionized into fragments due to the selection of a type of primary ion whose ionization potential (inner potential) lies only insignificantly above that of the species to be ionized. For example, $CH_3OH+Xe^+$only becomes $CH_3OH^++Xe$ or, respectively, $C_2H_5OH+Xe^+$ only becomes $C_2H_5OH^++Xe$. As a consequence of the selection of the ionization potential of the primary ions in accordance with the present invention, the separate identification of molecule concentrations of identical molecule masses is enabled in an extremely simple way by means of selective ionization.

For separate identification of hydrocarbon compounds, it is provided, according to a further development of the method of the invention, that the primary ions employed exhibit an internal energy slightly above, preferably $\leqq 2$ eV above, that required for generating a product ion upon simultaneous abstraction. The multitude of possibilities of making molecules of identical molecular mass distinguishable by the selective ionization process in the subsequent mass-spectrometric examination is expanded by this ionization with H-abstraction.

The following should be noted here regarding the technical term "H-abstraction":

In exothermic reactions of positively charged particles with molecules, specifically hydrocarbon compounds, the excess energy of the reaction (difference between the ionization potentials) is distributed in the following way:

(1) into translational energy of the reaction partners given a low $\Delta E$ ($<0.1$ eV) excess;

(2) into the molecules given $\Delta E<1$ eV oscillatory impulse of the bonds; and (3) given $\Delta E \approx 1$ eV$<3$ eV dissociation, i.e., separation of a bond (atom) with the lowest bonding energy, from the atomic bond≡molecule.

In hydrocarbon compounds, this is an H-atom ("H-abstraction"). In chloronated hydrocarbons, generally halogenated hydrocarbons, this is the halogen atom.

For the separate identification of metallo-organic compounds, the primary ions used, according to a further development of the invention, have an internal energy in the range from 4.5 to 6.8 eV. The probabilities of possible interferences with hydrocarbon compounds having the same molecular masses become greater and greater in the identification of metallo-organic compounds, so that the identification of the molecules on the basis of the characteristic isotope distributions becomes increasingly more difficult with the number of atoms in the molecule. The metallo-organic compounds whose ionization energies lie in this range are selectively ionized by the selection of the primary ions employed, this without simultaneous ionization of the hydrocarbon compounds, so that a simple mass-spectrometric detection becomes possible.

According to further developments of the invention, for separate identification of oxygen and methylalcohol; $CO_2$, CO, and $O_2$; or nitrogen monoxide and formaldehyde, krypton+ ions can be used as primary ions, these best satisfying the said demands made of the internal energy.

According to another, advantageous development of the invention, for separate identification of $CH_3OH$ and $C_2H_5OH$ or, respectively, of di-nitrogen monoxide and carbon dioxide, xenon+ ions can be used as primary ions.

BRIEF DESCRIPTION OF THE DRAWING

The only FIGURE is a cross-sectional view of an apparatus embodying principles of the invention having an ion beam emitter and a mass-spectrometer arranged at opposite ends of a chamber, wherein a gas mixture to be analyzed is introduced.

DETAILED DESCRIPTION OF THE PRESENTLY PREFERRED EMBODIMENTS

The method of the invention shall now be set forth in greater detail with reference to the following examples.

EXAMPLE 1

Separation of CO, $N_2$, $C_2H_6$ by selective ionization with $Kr^+$ ions (the eV value in parenthesis denotes the internal energy or, respectively, the ionization potential)

$$Kr^+(^2P_{3/2})\ (14\ eV)+N_2 \rightarrow N_2^+\ (15.5\ eV)+Kr;$$

$\Delta E=-1.5$ eV=endothermic charge exchange; ionization impossible.

$$Kr^+(^2P_{3/2})\ (14\ eV) + CO \longrightarrow \underset{28\ amu}{CO^+}(13.9\ eV) + Kr;$$

$\Delta E=+0.1$ eV=exothermic charge exchange, ionization at 28 amu; taking enthalpies of formation $\Delta H_f$ in kcal into consideration (1 eV $\triangleq$ 23.06 kcal).

$$Kr^+(2P_{3/2})\ (323) + C_2H_6(-20.2) \longrightarrow \underset{27\ amu}{C_2H_5^+}(219) + H(52) + Kr(0);$$

$\Delta E=31.8$ kcal$=1.4$ eV exothermic; ionization with H-abstraction at 27 amu; (for $Kr^++C_2H_6 \rightarrow C2H_6^++Kr$, $\Delta E$ would be high; the above reaction therefore ensues with considerably greater probability).

EXAMPLE 2

Separation of oxygen $O_2$ and methylalcohol $CH_3OH$ with selective ionization by $Kr^+$ ions.

$$Kr^+(14\ eV) + O_2 \longrightarrow \underset{32\ amu}{O_2^+}(12.1) + Kr;$$

$\Delta E=1.9$ eV exothermic; ionization at 32 amu.

$$Kr^+(^2P_{1/2})(338) + CH_3OH(-48) \longrightarrow$$

-continued $$CH_3O^+(232) + H(52) + Kr(0):$$

31 amu $\Delta E = +6$ kcal exothermic; ionization with H-abstraction at 31 amu.

EXAMPLE 3

Separation of nitrogen monoxide NO (30 amu) and formaldehyde $CH_2O) = (30$ amu).

30 amu $$Kr^+(14) + NO \longrightarrow NO^+(9.2) + Kr \ldots$$

$\Delta E = +4.8$ eV exothermic; ionization at 30 amu or $\rightarrow NO^+(a\Sigma^+)$ (14.2) . . . $\Delta E \simeq O$ (energy-resonant).

$$Kr^+(323) + CH_2O(-28) \longrightarrow CHO^+(221) + H(52) + Kr(0)$$

29 amu $\Delta E = +22$ kcal exothermic; ionization with H-abstraction at 29 amu.

EXAMPLE 4

Separation of di-nitrogen monoxide $N_2O$ (44 amu) and $CO_2$ (carbon dioxide) (44 amu) by selective ionization with $Xe^+$ ions.

44 amu $$Xe^+(13.4\ eV) + N_2O \longrightarrow N_2O^+(12.9) + Xe;$$

$\Delta E = 0.5$ eV; ionization at 44 amu.

$$Xe^+(13.4\ eV) + CO_2 \rightarrow CO_2^+(13.7) + Xe;$$

$\Delta E = -0.3$ eV exothermic; no ionization possible.

The method of the invention thus makes a fast analysis (real-time analysis) of gas mixtures possible, i.e. makes an identification of the individual molecular components in gas mixtures possible, this being of utmost interest for many applications in industry and research such as, for example: the study of rapidly occurring chemical reactions for clarification of the reaction kinetics; and the measurement of brief-duration, metastable intermediate products and radicals in chemical conversions or, respectively, catalytically functioning agents.

All applications of this type can be realized in accordance with the present invention wherein it is essentially provided that the ionization needed for the employment of the mass spectrometer, i.e. the conversion of all neutral molecules to be investigated into ions, is carried out with a positively or negatively charged, intense ion beam having a precisely defined, internal energy that enters into interaction with the molecules to be ionized. By selecting a type of primary ion whose internal energy lies only insignificantly higher than the ionization potential of the species to be ionized, the molecules are converted into ions without being ionized into fragments. The corresponding, translational pulse energy between the primary ions and the gas particles must thereby be kept so low that the kinetic effects on the ionization are small in comparison to the influence of the internal energy.

The apparatus of the invention for the identification of the concentration of individual types of molecule in gas mixtures shall be set forth in greater detail below with reference to the schematic drawing.

The apparatus comprises an ion source 1 of an arbitrary type of no farther interest here whose critical specification in the present context is such that the primary ions that are generated and that emerge from the ion source in the direction z have an internal energy slightly above, preferably $\leqq 2$ eV above that required for generating product ions representing the respective molecule type of interest and have a translational pulse energy of such a size in the respective center-of-mass system of primary ion/molecule that the kinetic effect on the ionization is negligible in comparison to the influence of the internal energy, preferably having a translational pulse energy below 10 eV. For example, a closed electron pulse ion source can thereby be employed, a primary gas A flowing therethrough. This primary gas A is ionized by electrons in processes $e^- + A \rightarrow A^+ + 2e^-$, wherewith primary ions $A^+$ are available.

A reaction space 2 joining to the ion source 1 is also provided, as is a mass spectrometer arrangement 3—preferably a quadrupole mass spectrometer—that joins the reaction space 2 in the principal moving direction z of the primary ions supplied by the ion source 1. The reaction space 2 to which the gas mixture to be examined can be supplied via a connector 4 is surrounded by octopole arrangement 5 having a radio frequency 8-pole field acting perpendicularly relative to the principal moving direction z of the primary ions, this radio frequency 8-pole field serving the purpose of collecting, holding or, respectively, guiding the primary ions that exhibit an extremely low kinetic energy. The product ions are selected in the mass spectrometer arrangement 3 or, respectively, in the corresponding quadrupole in a known way that is of no further interest here, and proceed to an ion sensor 6 that can likewise be of a known or, respectively, standard structure and whose function and action are of no further interest here.

A pump for hard vacuum evacuation of the reaction space 2 is referenced 10; various other auxiliary devices such as diaphragms or, respectively, lenses for the ion beam or further vacuum pumps and seals and the like that are partly indispensable for the function of the arrangement in standard operation are not shown here since they are of secondary significance in the context of the present invention.

In longitudinal direction—i.e. in the principal moving direction z of the primary ions emerging from the ion source 1 in a ray—, the octopole arrangement 5 is divided into three individual regions 7, 8, 9 that are electrically insulated from one another which—as seen from the ion source 1 to the mass spectrometer arrangement 3—lie at a respectively increasing negative dc potential in comparison to the preceding region. In addition to the radial guidance field produced by the radio frequency potential that holds the ions in the inside of the octopole arrangement 5, an E-field is produced in axial direction in this way, this seeing to a rapid and complete removal of the product ions in the direction toward the mass spectrometer and, thus, enabling a rapid analysis with high precision.

We claim:

1. An apparatus for identifying concentrations of individual types of molecules in a gas mixture, comprising:

a pre-treatment arrangement for selective pre-treatment of the gas mixture including an ion source for producing primary ions having an internal energy slightly above that required for generating product ions representing a type of molecule of interest and with a translation pulse energy below 10 eV, a chamber coupled to said ion source, a feed line in communication with an interior of said chamber for introduction therein of the gas mixture, a pump operatively coupled to the chamber and in communication with the interior thereof for creating a vacuum therein, and an octopole arrangement arranged within the chamber at which a radio frequency guide potential is adjacent; and a mass-spectrometer arrangement in communication with a discharge end of said chamber so that product ions emitted from the chamber are mass spectrometrically examined.

2. The method of claim 1 wherein the primary ions employed have an internal energy $\leqq 2$ eV above that required for generating product ions.

3. The method of claim 1, wherein the primary ions employed have a translational pulse energy less than about 10 eV.

4. The method of claim 1, wherein the primary ions employed have an internal energy $<2$ eV above that required for generating product ions and a translational pulse energy less than about 10 eV.

5. The method of claim 1, for separate identification of hydrocarbon compounds, the primary ions employed have an internal energy slightly above that required for generating a product ion given simultaneous H-abstraction.

6. The method of claim 5, wherein the primary ions employed have an internal energy less than about 2 eV above that required for generating a product ion given simultaneous H-abstraction.

7. The method of claim 5, wherein, for separate identification of metallo-organic compounds, the primary ions employed have an internal energy in the range from about 4.5 to about 6.8 eV.

8. The method of claim 5, wherein, for separate identification of oxygen ($O_2$) and methylalcohol ($CH_3OH$), krypton+ (Kr) ions are used as primary ions.

9. The method of claim 5, wherein, for separate identification of $CO_2$, CO, $O_2$, krypton+ (Kr) ions are employed as primary ions.

10. The method according to claim 5, wherein, for separate identification of $CH_3OH$ and $C_2H_5OH$, xenon+ (Xe) ions are employed as primary ions.

11. The method of claim 5, wherein, for separate identification of nitrogen monoxide (NO) and formaldehyde ($CH_2O$), krypton+ (Kr) ions are employed as the primary ions.

12. The method of claim 1, wherein, for separate identification of di-nitrogen monoxide ($N_2O$) and carbon dioxide ($CO_2$), xenon+ (Xe) ions are employed as the primary ions.

13. An apparatus for identifying concentrations of individual types of molecules in a gas mixture, comprising:

a pre-treatment arrangement for selective pre-treatment of the gas mixture including an ion source for producing primary ions, a chamber coupled to said ion source, a feed line in communication with an interior of said chamber for introduction therein of the gas mixture, a pump operatively coupled to the chamber and in communication with the interior thereof for creating a vacuum therein, and an octopole arrangement arranged within the chamber at which a radio frequency guide potential is adjacent; and a mass-spectrometer arrangement in communication with a discharge end of said chamber so that primary ions emitted from the ion source having an internal energy slightly above that required for generating product ions representing a type of molecule of interest and with a translation pulse energy below 10 eV are mass spectrometrically examined.

14. The apparatus of claim 13, wherein the primary ions produced have an internal energy less than or equal to about 2 eV above that required for generating product ions representing the type of molecule of interest.

* * * * *